US007069815B1

(12) United States Patent
Yu

(10) Patent No.: US 7,069,815 B1
(45) Date of Patent: Jul. 4, 2006

(54) CONTAINER OPENER

(75) Inventor: Siu Kwan Yu, Kowloon (HK)

(73) Assignee: Maxpat Trading & Marketing (Fareast) Limited, Tsimshatsui (HK)

( * ) Notice: Subject to any disclaimer, the term of this patent is extended or adjusted under 35 U.S.C. 154(b) by 0 days.

(21) Appl. No.: 11/084,998

(22) Filed: Mar. 17, 2005

(51) Int. Cl.
*B67B 7/14* (2006.01)

(52) U.S. Cl. ..... 81/3.4; 81/3.07; 81/3.37

(58) Field of Classification Search ..... 81/3.4, 81/3.07, 3.37, 3.42, 3.55, 3.56; 30/120.4; 220/288
See application file for complete search history.

(56) References Cited

U.S. PATENT DOCUMENTS 463,131 A * 11/1891 Allen ..... 81/3.4
1,436,571 A * 11/1922 Bokor ..... 30/120.4
1,994,415 A * 3/1935 Edwards et al. ..... 81/3.44
4,179,954 A * 12/1979 Whalen ..... 81/3.44
4,262,560 A * 4/1981 Hoffberger ..... 81/3.25
4,723,465 A * 2/1988 Hughes ..... 81/3.09
6,263,761 B1 * 7/2001 Ryder ..... 81/3.09
6,837,131 B1 * 1/2005 Bitonto et al. ..... 81/3.39

* cited by examiner

*Primary Examiner*—Lee D. Wilson
*Assistant Examiner*—Alvin J Grant
(74) *Attorney, Agent, or Firm*—Smith-Hill and Bedell

(57) ABSTRACT

A container opener comprising a handle portion on which force is applicable when removing a lid from a container and a utility portion for engaging with said lid to be removed from said container, one or both of said portions are generally made of a resilient but relatively stiff material, which said utility portion is provided with a gripping means made of an elastomeric material or a soft plastic material for gripping and/or simultaneous movement with said lid.

24 Claims, 5 Drawing Sheets

CONTAINER OPENER

FIELD OF THE INVENTION

The present invention is concerned with a device for removing a lid from a container such as a jar, a bottle or the like.

BACKGROUND OF THE INVENTION

There are a variety of conventional container openers or the like designed to assist users to remove a lid from a container by turning the lid and hence removing it therefrom. However, these conventional openers often do not address all the problems associated with difficulty of operation, damaging to the lid to be removed and/or high cost of manufacture.

The present invention seeks to provide a container opener which can mitigate the drawbacks of the prior art, or at least to provide the public with a useful choice.

SUMMARY OF THE INVENTION

According to a first aspect of the present invention, there is provided a container opener comprising a handle portion on which force is applicable when removing a lid from a container and a utility portion for engaging with the lid to be removed from the container, one or both of the hand and utility portions are generally made of a resilient but relatively stiff material and the utility portion is provided with a gripping means (preferably non-metallic gripping means) made of an elastomeric material or a soft plastic(s) material for engaging with and gripping onto the lid and for simultaneous movement with the lid. The provision of the non-metallic gripping means ensures that the lid to be removed would not be damaged because if the gripping means were metallic, it would be typically harder physically and might crack or deform the lid or at least often leave bite marks thereon. The use of an elastomeric material or a soft plastic(s) material for the gripping means enhances the frictional engagement with the lid without damaging the lid such that the utility portion and the lid can be turned simultaneously and conveniently.

Preferably, the opener and in particular the handle portion may be elongate in shape with the handle portion provided at one end and the utility portion provided at the opposite end. The handle portion may include a pair of arms between which the lid is placed in use, and the arms may be extended from the utility portion. The elongate opener and the provision the arms assist users in use by providing mechanical advantage for turning the lid. The opener may generally be of V-shaped with the arms spread apart at default which allows the lid to be conveniently placed in the utility portion.

Suitably, opposite facing surfaces may be defined by the gripping means. The surfaces engage and grip sides of the lid in use.

Advantageously, the opener may be adapted to assume a first, or default, configuration in which the arms are separated and a second, operable, configuration in which the utility portion or the gripping means is brought together to grip the sides of the lid for simultaneous turning or rotating movement. In particular, the utility portion may comprise at least two gripping regions of different sizes for removing lids of at least two categories of sizes, the smaller or the smallest gripping region may be arranged at the end of the opener opposite to the handle portion. The smaller or the smallest gripping region may be generally in the shape of the letter "C". More particularly, the utility portion or the gripping means may be provided with three gripping regions of different sizes or may particularly be sized and shaped to remove lids having a diameter from about 16 mm to 50 mm such that one such opener can be used to remove a variety of lids of different sizes.

Suitably, the resilient but relatively stiff material may be polypropylene (PP), acrylonitrile butadiene styrene (ABS), polyamide (PA), polycarbonate (PC), polybutylene terephthalate (PBT), polyethylene terephthalate (PET) or acetal copolymer (POM). These materials are particular desirable not only because they are resilient and relatively stiff, but also relatively light and inexpensive. The resilient but relatively stiff material may alternatively be a metallic material of a metal alloy. Among other characteristics, a metallic material or a metal alloy material is however typically more costly and may not be suitable for a low-end product. The utility portion or particularly the gripping means may be free of any teeth means, groove means or metallic means which could easily damage the lid.

The elastomeric material may preferably comprise or be a thermoplastic elastomer selected from the group consisting of styrene-butadiene-styrene based theremoplastic elastomer and styrene-ethylene-butylene-styrene based thermoplastic elastomer. The soft plastic(s) material may preferably comprise or be silicone. Elastomeric materials or soft plastic (s) materials are desirable because the gripping means made therewith can engage a reliable frictional relationship with lids.

According to a second aspect of the present invention, there is provided a container opener of elongate shape comprising a handle portion at one end and a utility portion at the opposite end, one or both of said portions are generally made of a resilient but relatively stiff material, which the handle portion comprises a pair of ares extending from the utility portion, wherein the utility portion may be provided with a gripping means made of an elastomeric material or a soft plastic(s) material for gripping a lid to be removed for simultaneous movement therewith, and wherein the gripping means is free of any teeth means, groove means or metallic means.

Preferably, the opener may be adapted to assume a first configuration in which the arms are separated and a second configuration in which the utility portion is brought together towards and for gripping the lid for simultaneous turning or rotating movement.

Suitably, the resilient but relatively stiff material may be polypropylene (PP), acrylonitrile butadiene styrene (ABS), polyamide (PA), polycarbonate (PC), polybutylene terephthalate (PBT), polyethylene terephthalate (PET) or acetal copolymer (POM). The resilient but relatively stiff material may alternatively be a metallic material of a metal alloy.

The elastomeric material may preferably comprise or be a thermoplastic elastomer (TPE) selected from the group consisting of styrene-butadiene-styrene based theremoplastic elastomer (SBS based TPE) and styrene-ethylene-butylene-styrene based thermoplastic elastomer (SEBS based TPE). The soft plastic(s) material may preferably comprise or be silicone. Both the elastomeric material and silicone are soft and has good gripping property.

BRIEF DESCRIPTION OF THE DRAWINGS

An embodiment of the present invention is described, by way of example only, with reference to the following drawings in which.

DETAILED DESCRIPTION OF THE PREFERRED EMBODIMENT

Figure 1:
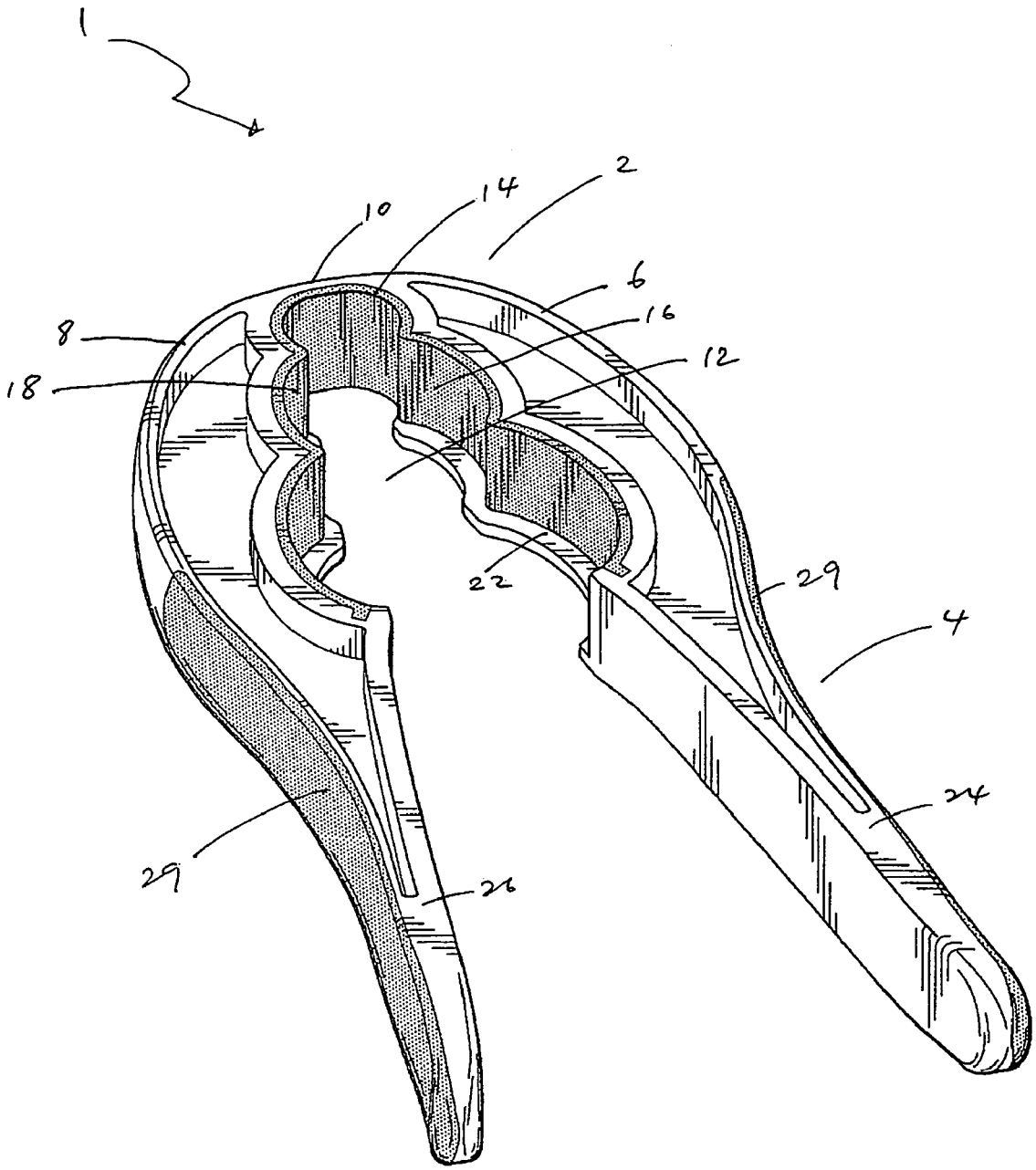
FIG. 1 is a perspective view from below showing a container opener in a default configuration according to an embodiment of the invention.
Figure 2:
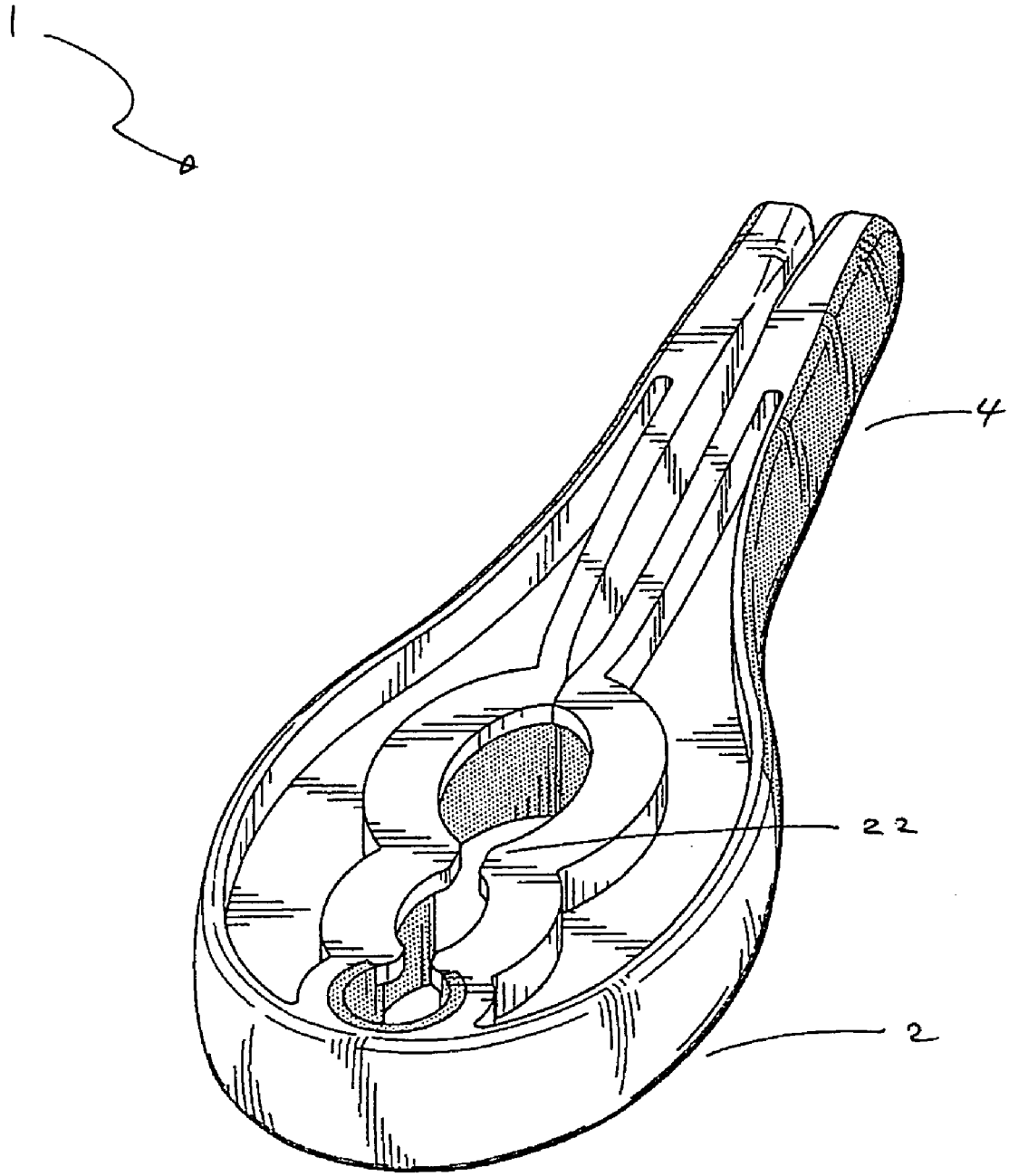
FIG. 2 is a top perspective view of the opener of FIG. 1 but in a different configuration.

The invention is concerned with a container opener or more commonly called a jar opener. The jar opener, generally designated 1, is shown in FIGS. 1 to 6 and is elongate in shape. As shown particularly in FIGS. 1, 3 and 5, the opener 1 is generally V-shaped when viewed invertedly.

The opener 1 comprises a utility portion 2 and a handle portion 4 extended therefrom. The opener 1 is generally made of polycarbonate which is a resilient but relatively stiff material although other suitable materials having this required resilient and stiff physical property may also be used. These other materials include polypropylene (PP), acrylonitrile butadiene styrene (ABS), polyamide (PA), polycarbonate (PC), polybutylene terephthalate (PBT), polyethylene terephthalate (PET) or acetal copolymer (POM).

The utility portion 2 is integrally formed and comprises two wings 6, 8 connected together at a junction 10 at the front end of the opener 1. The utility portion 2 is provided with a gap 12 between the wings 6, 8 and wherein a lid of a container to be removed may be placed. The utility portion 2 is additionally provided with a layer thermoplastic elastomeric material (TPE) 14 and particularly a layer of styrene-butadiene-styrene based thermoplastic elastomer (SBS based TPE) material although styrene-ethylene-butylene-styrene based thermoplastic elastomer (SEBS based TBE) or a soft plastic(s) material such as silicone may also be used. The layer of TPE 14 is fixedly attached to the inner side of the utility portion, defines opposite facing surfaces 16, 18 between which the lid is placed in use, and defines an elongate gripping area 20 (see also FIGS. 5 and 6) in which the lid is gripped. While in this embodiment the junction 10 is not provided with any hinge means, the junction 10 serves as a hinge at which the wings 6, 8 can pivot. It is envisaged that a hinge means may be provided at the junction.

Figure 5:
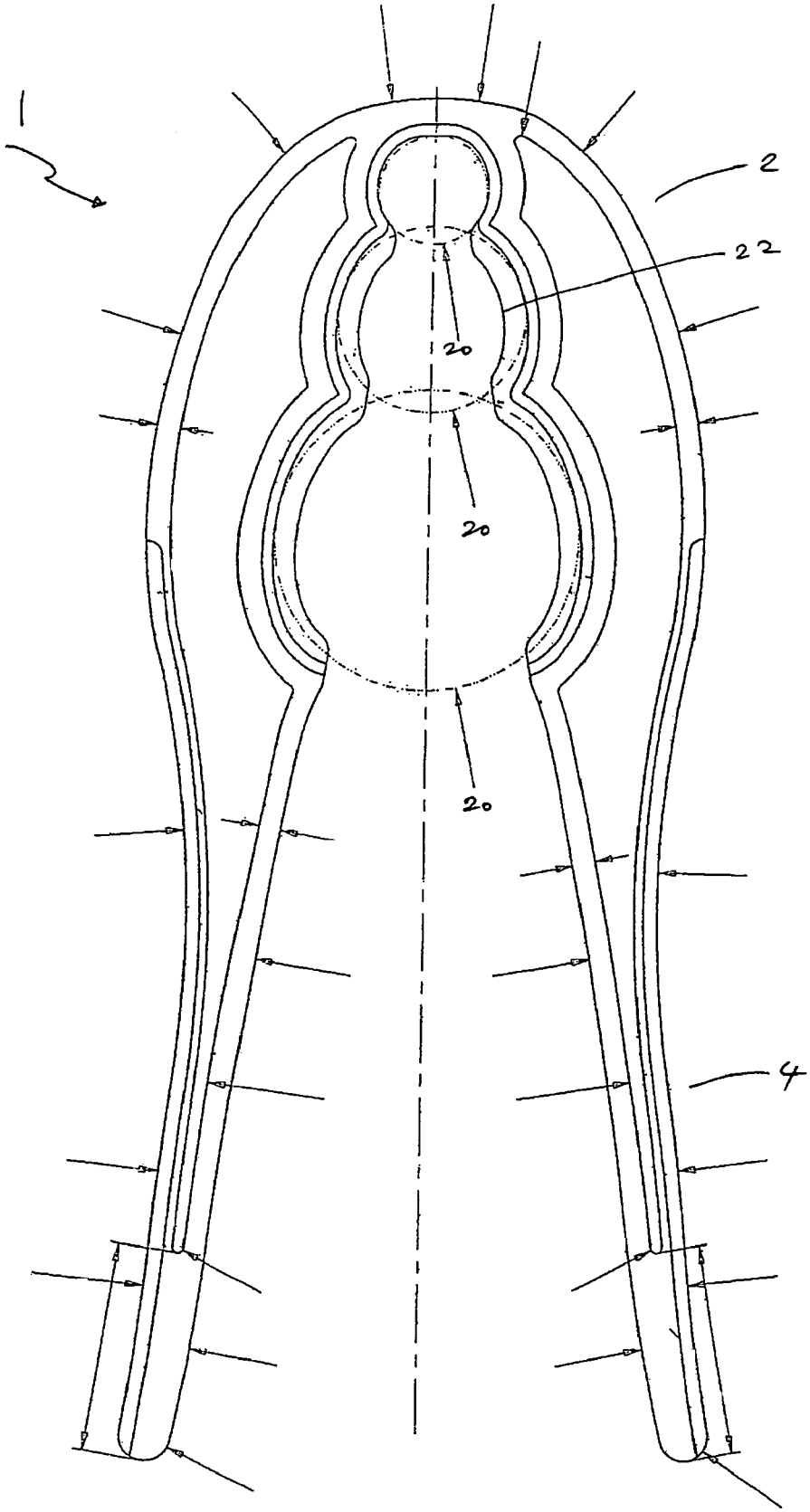
FIG. 5 is a schematic engineering drawing of the opener of FIG. 1.
Figure 6:
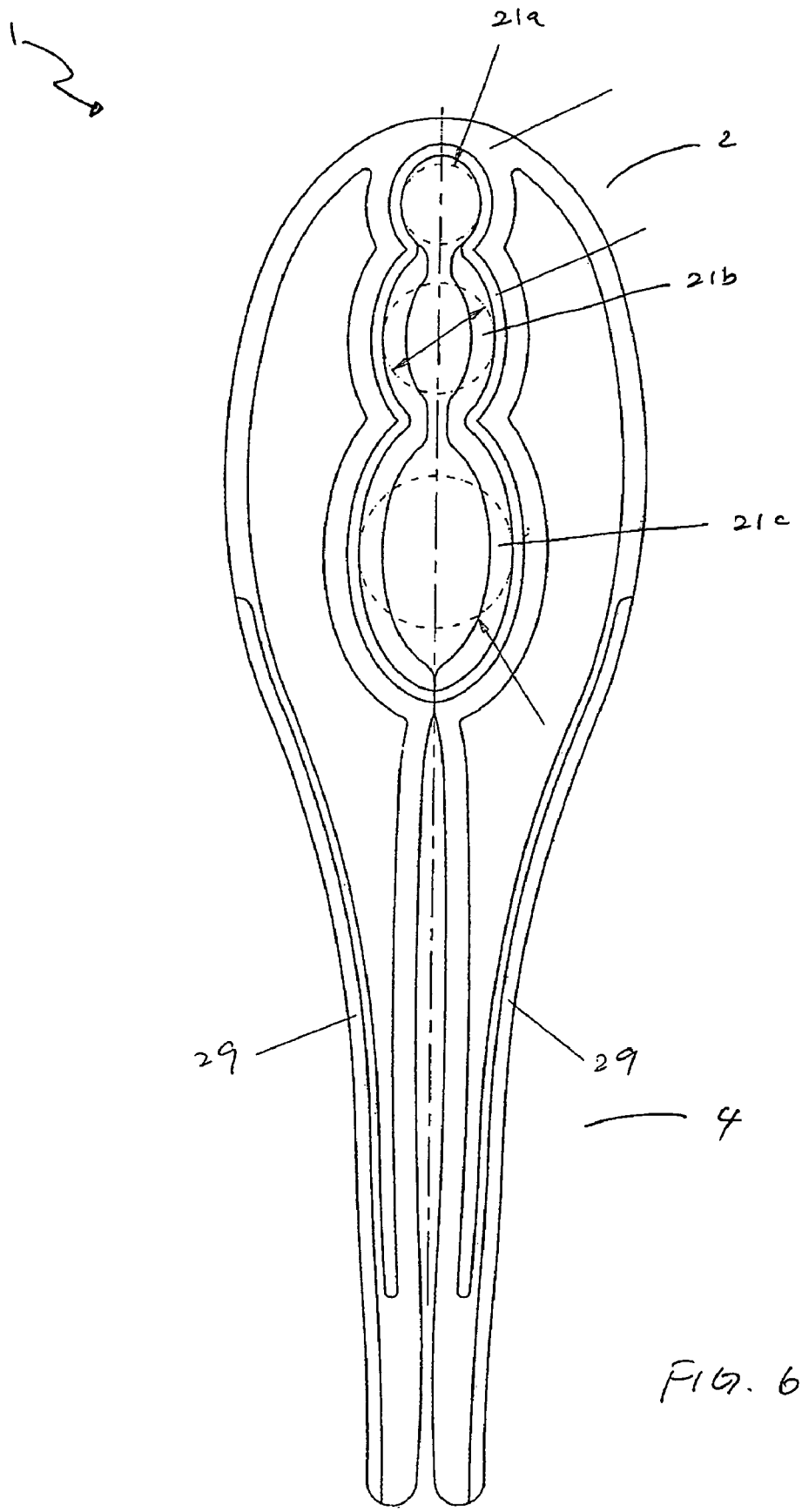
FIG. 6 is a schematic engineering drawing of the opener of FIG. 1.

As best illustrated in FIGS. 5 and 6, the utility portion 12 is provided with a flange 22 surrounding the upper side of the gripping area 20. In particular, the gripping area 20 generally comprises three gripping regions 21*a*, 21*b*, 21*c* of successive larger sizes with the region 21*a* at the front end of the opener 1 being smallest and the region 21*c* closest to the handle portion 4 being the largest.

The handle portion 4 comprises a pair of arms 24, 26, each extending from the respective wing 6, 8 of the utility portion 2. Each of the arms 24, 26 and the respective wing 6, 8 are integrally formed. The handle portion 4 is provided with a thin layer 28 of elastomeric material similar to the elastomeric material of the utility portion 2 on its outer sides 29, and this elastomeric layer allows better gripping by users on the arms 24, 26.

It is to be noted that the jar opener 1 illustrated in this embodiment can remove lids of three categories of sizes. For examples, lids that are relatively small may be removed at the smallest gripping region 21*a* and lids that are relatively large may be removed at the largest gripping region 21*c*. Referring to FIGS. 5 and 6, depending on the configuration of the opener 1, the smallest region 21*a* indicated by the upper dotted circle ranges from about 13.7 mm to 18.3 mm in diameter such that lids having a diameter in this range may be removed at this region. The diameter of the largest region 21*c* indicated by the lower dotted circle ranges from about 26 mm to 52.7 mm in diameter such that lids having a diameter in this range may be removed at this region. The diameter of the middle region 21*b* indicated by the middle dotted circle ranges from about 19.3 mm to 32.2 mm. It is thus envisaged that the jar opener of this embodiment may remove lids having a diameter from about 13.7 mm to 52.7 mm. However, experiments have shown that it would be difficult to remove lids having a diameter of 13.7 mm or less with the opener of this embodiment arms 24, 26 because the handle portion 4 would need to be squeezed very closely together with an unusually greater force. Likewise, it would be difficult to remove lids having a diameter of 52.7 mm or above because such large lids placing the lid in the largest gripping region would be relatively inconvenient. Experiments have shown that the jar opener of this embodiment is preferably used to remove lids having a diameter of about 16 mm to 50 mm. This embodiment has been test to be able to effectively remove relatively small lids, such as removing caps from nail polish bottles, at the region 21*a*. Of course, embodiments of different sizes may be made for removing lids falling outside of this range of diameter.

Figures 3, 4:
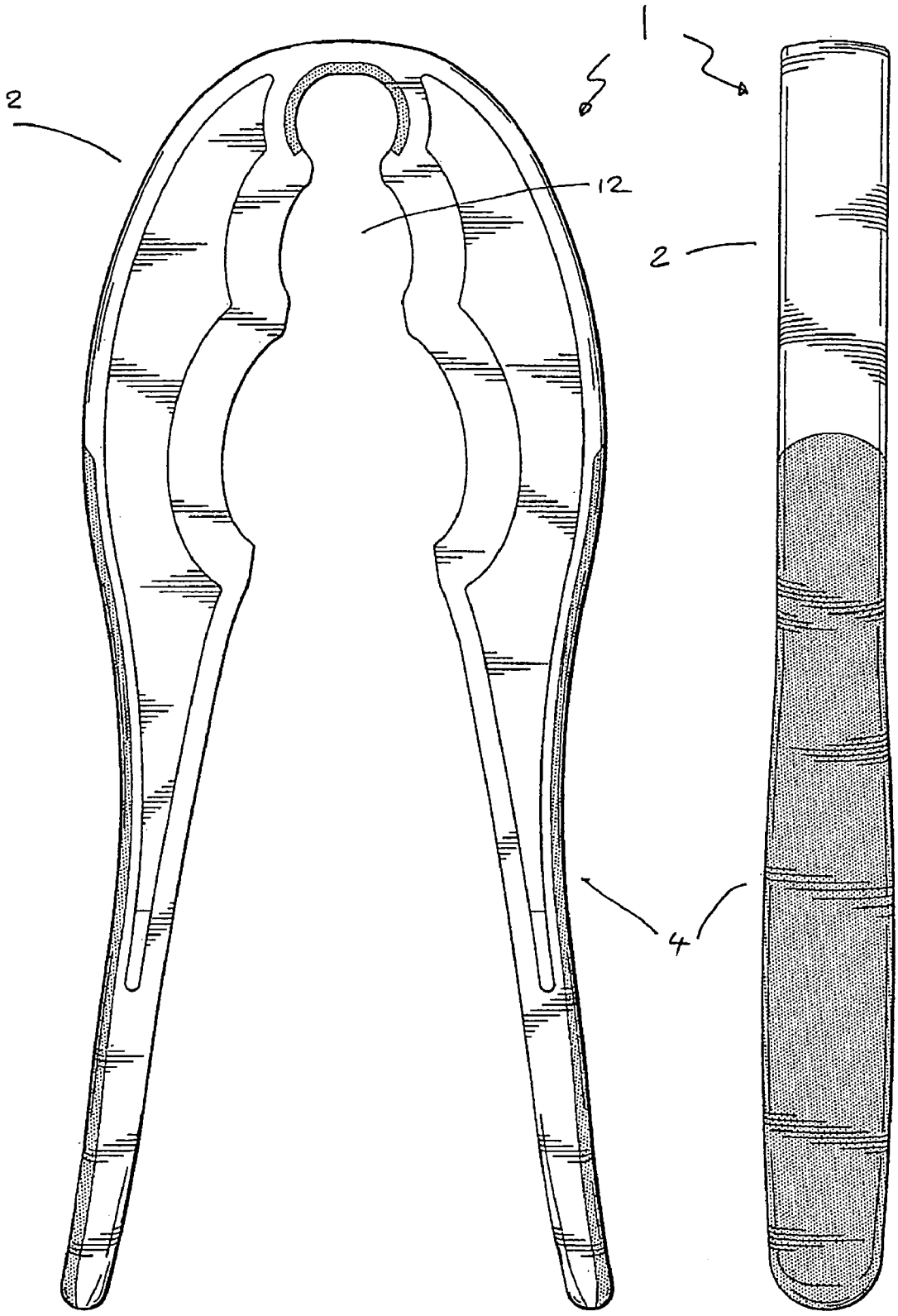
FIG. 3 is a top view of the opener of FIG. 1.
FIG. 4 is a side view of the opener of FIG. 1.

In use, the opener 1 in its default configuration (as shown in FIG. 3) is placed above a container having a lid (not shown) to be removed therefrom with the side of the opener (i.e. the side having the flange) upwardly facing. In particular, the lid is placed in the gap 12 at the appropriate selected gripping region (21*a*, 21*b* or 21*c*) between the opposite facing surfaces 16, 18 of the SBS based TPE gripping area 20. The arms 24, 26 are then brought together by squeezing them together with one hand until the opposite facing surfaces 16, 18 touch opposite sides of the lid. At this point, the arms 16, 18 actually bend slightly due to its resilience and stiffness thereof. The opposite facing surfaces 16, 18 then frictionally engage with and grip the opposite sides of the lid and the opener 1 adopts a squeezed configuration. Due to the elastomeric nature of the gripping area 20, it deforms slightly. As the arms 24, 26 are continued to be squeezed and then are turned (normally in anti-clockwise direction for removing the lid), the lid is simultaneously turned with the opener 1 and thus loosened from the container and then be removed from the container. It is to be envisaged that after releasing the arms, the opener resumes to its default configuration due to its inherent resilience and stiffness. While metallic materials or metal alloys having similar resilience and stiffness may be used in place of the SBS based TPE type material, they may not be desirable at least to the extent that they are typically on one hand heavier and thus less user friendly and on the other hand more costly to manufacture.

The invention claimed is:

1. An opener for containers, such as jars or nail polish bottles comprising a handle portion on which force is applicable when removing a lid from a container or a bottle and a utility portion for engaging with said lid to be removed, one or both of said portions are generally made of a resilient but relatively stiff plastic(s) material, wherein said utility portion is provided with a gripping means made of an elastomeric material or a soft plastic(s) material for simultaneous movement with said lid, and with a flange against which a top of the lid to be removed is put in use.

2. An opener as claimed in claim 1 wherein said opener is elongate in shape, and wherein said handle portion is provided at one end and said utility portion provided at the opposite end.

3. An opener as claimed in claim 1 wherein said opener is generally of V-shaped.

4. An opener as claimed in claim 1 wherein said handle portion includes a pair of arms extending from said utility portion.

5. An opener as claimed in claim 1 wherein in use said lid is placed between a pair of arms extended from said handle portion.

6. An opener as claimed in claim 1 wherein said gripping means defines opposite facing surfaces and wherein in use said lid is placed between said surfaces.

7. An opener as claimed in claim 1 wherein said opener is adapted to assume a first configuration in which said arms are separated and a second configuration in which said utility portion or said gripping means is brought together to grip sides of said lid for simultaneous turning or rotating movement.

8. An opener as claimed in claim 1 wherein said utility portion comprises at least two gripping regions of different sizes, the smaller or the smallest gripping region is arranged at an end of said opener opposite from said handle portion.

9. An opener as claimed in claim 8 comprising three said gripping regions.

10. An opener as claimed in claim 1 wherein said utility portion is sized and shaped to remove lids having a diameter from about 16 mm to 50 mm.

11. An opener as claimed in claim 1 wherein said resilient but relatively stiff plastic(s) material comprises polypropylene, acrylonitrile butadiene styrene, polyamide, polycarbonate, polybutylene terephthalate, polyethylene terephthalate or acetal copolymer.

12. An opener as claimed in claim 1 wherein said utility portion or said gripping means is free of any teeth means, groove means or metallic means.

13. An opener as claimed in claim 1 wherein said utility portion is integrally formed.

14. An opener as claimed in claim 1 wherein said soft plastic(s) material comprises silicone.

15. An opener as claimed in claim 1, wherein said container opener is sized and shaped to remove lids having a diameter from 13.7 mm to 52.7 mm.

16. An opener for containers, such as jars or nail polish bottles of elongate shape comprising a handle portion at one end and a utility portion at the opposite end, one or both of said portions are generally made of a resilient but relatively stiff plastic(s) material, wherein said handle portion including a pair of arms extending from said utility portion, wherein said utility portion is provided with a gripping means made of an elastomeric material or a soft plastic(s) material for gripping a lid to be removed for simultaneous movement therewith and with a flange against which a top of a lid to be removed is put in use, and wherein said gripping means is free of any teeth means, groove means or metallic means.

17. An opener as claimed in claim 16 wherein a pair of arms are extended from said handle portion and said opener is adapted to assume a first configuration in which said arms are separated and a second configuration in which said utility portion is brought together towards and for gripping said lid for simultaneous turning or rotating movement.

18. An opener as claimed in claim 16 wherein said resilient but relatively stiff plastic(s) material comprises polypropylene, acrylonitrile butadiene styrene, polyamide, polycarbonate, polybutylene terephthalate, polyethylene terephthalate, acetal copolymer.

19. An opener as claimed in claim 16 wherein said utility portion is integrally formed.

20. An opener as claimed in claim 16 wherein said soft plastic(s) material comprises silicone.

21. An opener as claimed in claim 16 wherein said container opener is sized and shaped to remove lids having a diameter from 13.7 mm to 52.7 mm.

22. An opener for containers, such as jars or nail polish bottles comprising a handle portion on which force is applicable when removing a lid from a container and a utility portion for engaging with said lid to be removed, wherein one or both of said utility portion are generally made of a resilient but relatively stiff material, wherein said utility portion is provided with a gripping means made of an elastomeric material or a soft plastic(s) material for simultaneous movement with said lid and wherein said utility portion is provided with a flange against which a top of a lid to be removed is put in use.

23. An opener as claimed in claim 22 wherein said resilient but relatively stiff material is a plastic(s) material.

24. An opener as claimed in claim 22 wherein said elastomeric material or soft plastic(s) material is selected from the group consisting of styrene-butadiene-styrene based thermoplastic elastomer and styrene-ethylene-butylene-styrene based thermoplastic elastomer.

* * * * *